United States Patent [19]

Schutz

[11] 4,361,085

[45] Nov. 30, 1982

[54] EMBOSSING APPARATUS

[75] Inventor: Rudolph W. Schutz, Walnut Creek, Calif.

[73] Assignee: Crown Zellerbach Corporation, San Francisco, Calif.

[21] Appl. No.: 272,142

[22] Filed: Jun. 11, 1981

[51] Int. Cl.[3] ..... B31F 1/00; B44B 5/00

[52] U.S. Cl. ..... 101/23; 101/6; 101/376; 100/211; 29/121.6

[58] Field of Search ..... 101/23, 5, 6, 22, 32, 101/376; 29/121.1, 121.6; 100/211; 400/662, 661.3

[56] References Cited

U.S. PATENT DOCUMENTS

| | | | |
|---|---|---|---|
| 1,553,352 | 9/1925 | Amidon et al. | 101/23 |
| 1,942,305 | 1/1934 | Petz | 400/662 X |
| 3,893,795 | 7/1975 | Nanta | 101/23 X |

*Primary Examiner*—Paul T. Sewell
*Assistant Examiner*—Daniel J. Roock
*Attorney, Agent, or Firm*—Thomas R. Lampe

[57] ABSTRACT

Embossing apparatus employing a grooved, finned, deformable outer element for defining a nip with an embossing roll, the deformable outer element having a durometer in the range of about 40 to about 80 shore "A".

2 Claims, 3 Drawing Figures

EMBOSSING APPARATUS

BACKGROUND OF THE INVENTION

1. Field of Invention

This invention relates to apparatus for embossing paper toweling, tissue and similar web materials.

2. Description of the Prior Art

A conventional arrangement for applying an embossment pattern to paper toweling, tissue, etc. is a two roll press comprising a steel or otherwise hard roll having the embossment pattern formed thereon and a rubber roll forming a nip with the hard roll through which the sheet material to be embossed is passed. Both hard and soft rubber rolls have been used for this purpose but each has drawbacks. The use of soft rubber rolls gives good embossment definition at relatively light nip pressures; however, soft rubber rolls generate too much heat and wear out quickly. To get good definition with the use of hard rubber rolls very high nip pressure must be exerted which reduces sheet caliper and strength to an undesirable degree.

BRIEF SUMMARY OF THE INVENTION

The present invention relates to embossing apparatus employing a rotatable platen roll having a grooved, deformable outer element for defining a nip with an embossing roll. The deformable outer element has a durometer in the range of from about 40 to about 80 shore "A" and has grooves to provide a plurality of spaced fins extending about the periphery of the platen roll. When the nip is formed the fins displace into the grooves and eliminate the need for high pressures to be exerted as is required by ungrooved hard rubber rolls to get conformance to the steel roll embossments. In addition, the grooved platen roll will not build up heat as is the case with soft rubber rolls. The fins formed by the grooves are believed to function as radiators contributing to the cooling of the platen roll.

DETAILED DESCRIPTION

Figure 1:
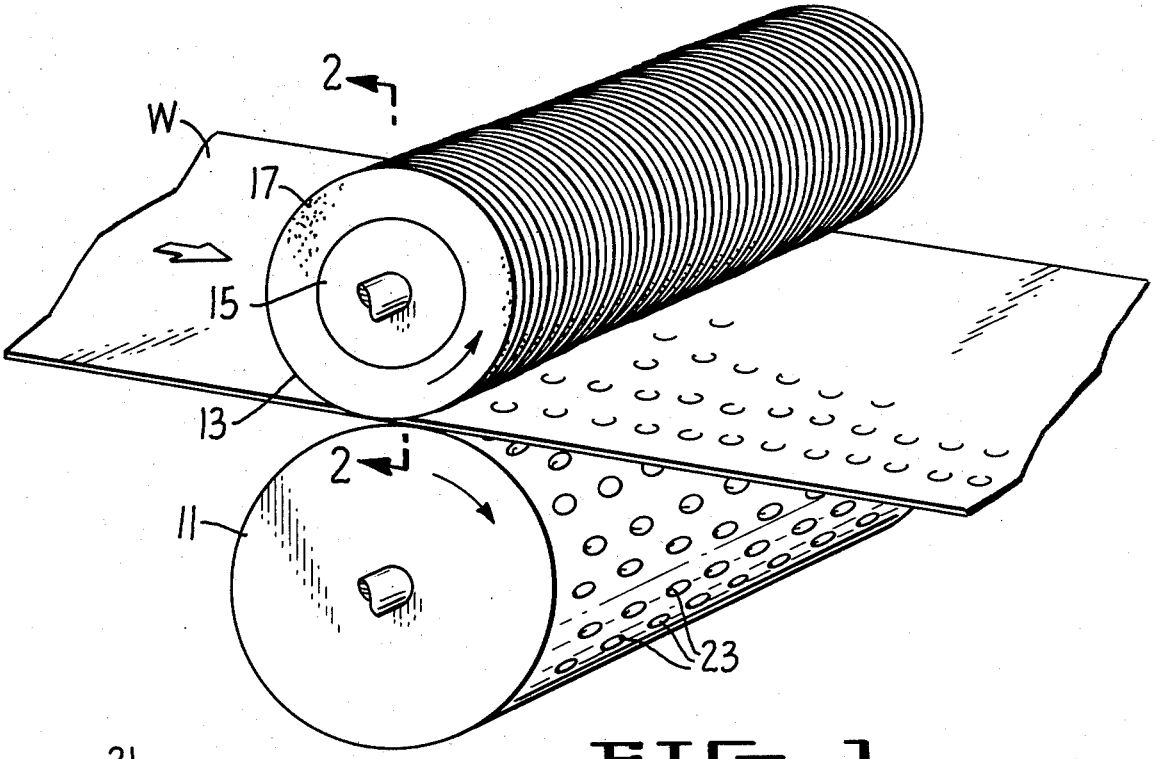
FIG. 1 is a perspective view of an embossing roll defining a nip with a rotatable platen roll constructed in accordance with the teachings of the present invention and showing web material passing through the nip.

FIG. 1 illustrates apparatus constructed in accordance with the teachings of the present invention wherein a rotatable embossing roll 11 formed of a rigid material such as steel or the like forms a nip with a rotatable platen roll 13 through which a web W of paper tissue, toweling or the like passes. The platen roll 13 in the embodiment illustrated includes a solid steel core 15 having disposed thereabout deformable outer element 17. Both rolls are supported by suitable bearing structure (not illustrated) in the usual manner so that an appropriate nip pressure may be obtained therebetween. Outer element 17 may be constructed of synthetic poly material, rubber or any other suitable natural or synthetic resiliant material falling within the durometer range of from about 40 to about 80 shore "A". Suitable conventional drive means (not shown) rotates the rolls so that the outer peripheral speeds thereof are substantially equal.

Figure 2:
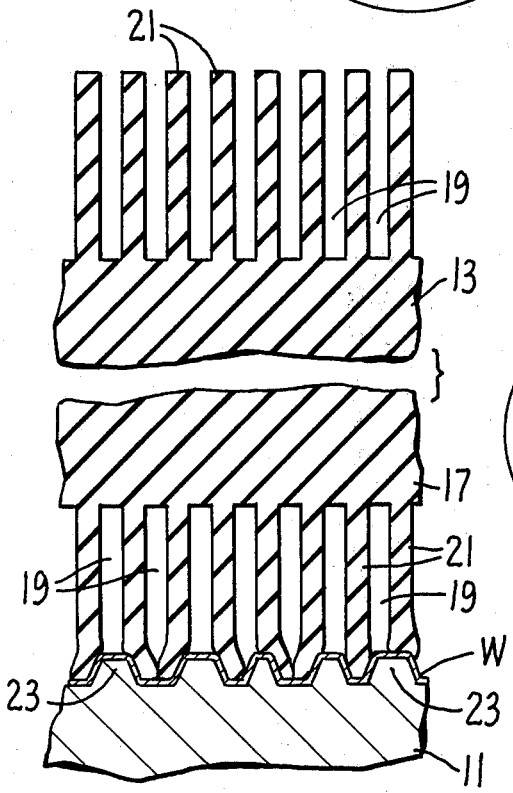
FIG. 2 is an enlarged view taken along line 2—2 in FIG. 1 and showing details of the fins of the platen roll.

As may best be seen with reference to FIG. 2 grooves 19 are cut or otherwise formed in the deformable outer element. The grooves 19 extend about the periphery of the platen roll so that a plurality of spaced, radially projected fins 21 are formed in the deformable outer element. The fins 21 define a land area constituting from about 40% to about 80% of the total peripheral surface of the platen roll when the platen roll is not subjected to external pressure. The depth of the grooves 19 lies in the range of from about 0.06 in. to about 0.25 in. when the platen roll is not subjected to external pressure. As may be seen in FIG. 2 when fins 21 contact web W in the nip formed between the embossing roll and the platen roll they deform under nip pressure into grooves 19 to provide a yieldable platen surface conforming to the configuration of projections 23 formed on the embossing roll. Thus, although the platen roll outer element is constructed of relatively hard material, the fins and grooves cooperate to provide a "soft" surface at the nip point. Also, the fins tend to radiate heat to contribute to cooling of the platen roll.

Figure 3:
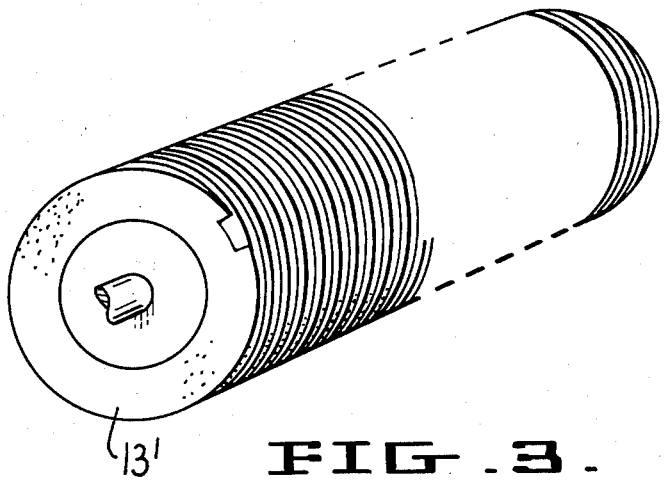
FIG. 3 is a perspective view of an alternative form of platen roll.

FIG. 3 shows a platen roll 13' which is similar in construction to platen roll 13 except that the grooves and fins thereof are formed helically in the roll rather than at right angles to the major axis thereof as is the case in the FIG. 1 embodiment.

A platen roll similar in construction to that shown in FIG. 1 was used in conjunction with a steel embossing roll to form a web embossing nip. The platen roll deformable outer element which was constructed of hard rubber material had a shore "A" durometer of 52 and employed 0.030 in. wide grooves, 0.25 in. deep, spaced on 0.060 in. centers. Such a roll produced a finish sheet caliber on a 32 lb. toweling face sheet of 19 mils as compared to 14 mils on an ungrooved roll of the same durometer.

I claim:

1. Apparatus for embossing paper and similar web material comprising the combination of:

a rotatable embossing roll having an embossment surface defining raised projections; and a rotatable platen roll having a grooved, deformable outer element for defining a nip with said embossing roll, said deformable outer element having a generally uniform durometer in the range of from about 40 to about 80 shore "A" and grooved to provide a plurality of spaced circular substantially continuous fins extending radially about the complete periphery of said platen roll, said fins adapted to deform under nip pressure into said grooves and to provide a yieldable platen surface conforming to the configuration of said embossing projections, said spaced substantially continuous fins defining a generally smooth land area constituting from about 40% to about 80% of the total peripheral surface of said platen roll when said platen roll is not subjected to external pressure and the depth of said grooves being in the range of from about 0.06 in. to about 0.25 in. when said platen roll is not subjected to external pressure.

2. A platen roll for embossing paper and similar web material having a grooved, deformable outer element for defining a nip with an embossing roll having raised projections, said deformable outer element having a generally uniform durometer in the range of from about 40 to about 80 shore "A" and grooved to provide a plurality of spaced circular substantially continuous fins extending about the complete periphery of said platen roll, said fins adapted to deform under nip pressure into said grooves to provide a yieldable plate surface conformable to the embossing roll projections, said spaced substantially continuous fins defining a generally smooth land area constituting from about 40% to about 80% of the total peripheral surface of said platen roll when said platen roll is not subjected to external pressure and the depth of said grooves being in the range of from about 0.06 in. to about 0.25 in. when said platen roll is not subjected to external pressure.

* * * * *